US005183717A

United States Patent [19]

May et al.

[11] Patent Number: 5,183,717

[45] Date of Patent: Feb. 2, 1993

[54] FIELD-ENHANCED CHARGE INJECTION AMPLIFICATION

[75] Inventors: John W. May, Rochester; Anujit Mukherjee, Pittsford, both of N.Y.

[73] Assignee: Eastman Kodak Company, Rochester, N.Y.

[21] Appl. No.: 562,347

[22] Filed: Aug. 3, 1990

[51] Int. Cl.[5] ..... G03G 12/22

[52] U.S. Cl. ..... 430/97; 430/31; 430/54; 430/107; 430/117

[58] Field of Search ..... 430/97, 54, 31

[56] References Cited

U.S. PATENT DOCUMENTS 3,775,106 11/1973 Tamai et al. ..... 96/1.2
4,465,749 8/1984 May et al. ..... 430/54
5,077,159 12/1991 Ng et al. ..... 430/54

*Primary Examiner*—Marion E. McCamish
*Assistant Examiner*—Rosemary Ashton
*Attorney, Agent, or Firm*—Leonard W. Treash, Jr.

[57] ABSTRACT

A weak electrostatic image on an imaging member is amplified by first toning it with a charge injection toner. The imaging member is recharged without fusing the toner image to a charge of the same polarity as the first charge but substantially higher potential. The excess charge over the first charge injects through the toner to create an amplified electrostatic image that can be toned.

8 Claims, 2 Drawing Sheets

FIELD-ENHANCED CHARGE INJECTION AMPLIFICATION

CROSS-REFERENCE TO RELATED APPLICATION

This application is related to co-assigned U.S. patent application Ser. No. 07/463,218, entitled IMPROVED CHARGE INJECTION AMPLIFICATION, filed Jan. 10, 1990, in the names of Yee S. Ng and Frederick R. Gilley now U.S. Pat. No. 5,077,159.

FIELD OF THE INVENTION

This invention relates to electrophotography and more specifically to an improved form of image amplification using charge injection toners.

BACKGROUND ART

U.S. Pat. No. 4,465,749 issued Aug. 14, 1984 to J. W. May and Y. S. Ng, discloses a method of amplifying an electrostatic image using charge injection toners. This patent application is an improvement of that method, and that patent is incorporated by reference herein.

According to U.S. Pat. No. 4,465,749, a weak electrostatic image is formed by exposing a charged photoconductive member, for example, an image formed from exposure to starlight, a radiographic image using very low exposure, or an exposure of an intensity comparable to those in conventional photographic cameras. This weak exposure creates an image having a voltage differential as small as 20 volts between the image areas and the background areas. That image is toned with a charge injection toner creating a weak toner image which would ordinarily not be particularly useful because it is barely visible. The weak toner image is fused to the photoconductor and the photoconductive member is recharged. The charge injection characteristics of the toner cause charge to leak through the toner and the photoconductive member to the underlying electrode creating a substantially enhanced electrostatic image which can be toned. Amplifications are possible with this approach of 5–30 times with good resolution. Using this method overall system speeds can be obtained comparable to that available with ordinary ASA 100 silver halide photographic film.

The amplified toner image can be transferred to a receiving sheet. Additional copies of the same image can be made from the same low density fused image using a form of xeroprinting. However, the imaging member itself is not readily reusable for a new image because of the fused image of charge injection toner. Although processes are known in which masters for xeroprinting are reused by using solvents or scraping action to remove the toned image, such steps greatly restrict the materials usable and are not considered practical.

DISCLOSURE OF THE INVENTION

It is the object of the invention to provide a method of amplifying electrostatic images using charge injection toners in which the toner does not have to be fused to the imaging member. It is a further object to improve the charge injection amplification method by reducing the number of processing stations. It is yet a further object of the invention to provide a charge injection amplification technique having a higher gamma sensitometric response.

These and other objects are accomplished by a process which is essentially the same as the prior art process to the point at which the charge injection toner has been applied to the imaging member to create a weak toner image. At this point, rather than fusing the image, the imaging member is charged with a charge of the same polarity used in creating the original weak electrostatic image but of a substantially higher potential. We have found that a substantial portion of the additional charge applied to the charge-injection toner will leak off allowing toned areas to approach the potential of the original electrostatic image thereby creating a greatly amplified electrostatic image that can be toned in a second toning operation. For low coverages of toner, the amount of said additional charge that leaks off in a given area of the imaging member is increased as the local coverage of toner in that area is increased, thereby providing gray scale response.

It is our belief that the fusing step of the prior art thoroughly eliminates all charges associated with the imaging member in both background and image areas. Fusing also forces the toner into increased intimate contact with the imaging member, thereby reducing the contact resistance. Apparently, when the fusing step is eliminated, the charge underneath the unfused toner associated with the toner-imaging member interface inhibits injection of charge into the imaging member. In practicing this invention, the effect of the charge at the interface is overcome by charging the toned imaging member to a potential substantially above that level. The toner then allows injection at least down to the level of the charge associated with the interface.

According to a further preferred embodiment, the invention works best with a liquid toner as the charge injection toner, because of greater contact with the imaging member. However, amplification can also be obtained with unfused dry toners, especially small particle toners.

A primary advantage associated with the invention is elimination of the fusing step. This not only eliminates an expensive piece of equipment required to carry out the fusing process, but permits reuse of the photoconductor when the photoconductor can be readily cleaned, as with dry toners.

Another advantage of the process is the increased gamma of the sensitometric response, as defined, for example, in *The Theory Of The Photographic Process*, Ed. T. H. James, MacMillian Publications, 4th Edition, 1977, Chapter 17, p. 502. Gamma is sometimes referred to as contrast, and is the slope of the curve of output density as a function of log exposure. In the present invention, gamma is considerably higher than produced with conventional electrophotography using the same photoconductor and the same toner. This means that the photographic speed improvement is more pronounced for higher output densities.

BRIEF DESCRIPTION OF THE DRAWINGS

In the detailed description of the preferred embodiment of the invention presented below, reference is made to the accompanying drawings, in which.

DISCLOSURE OF THE PREFERRED EMBODIMENT

Figure 1:
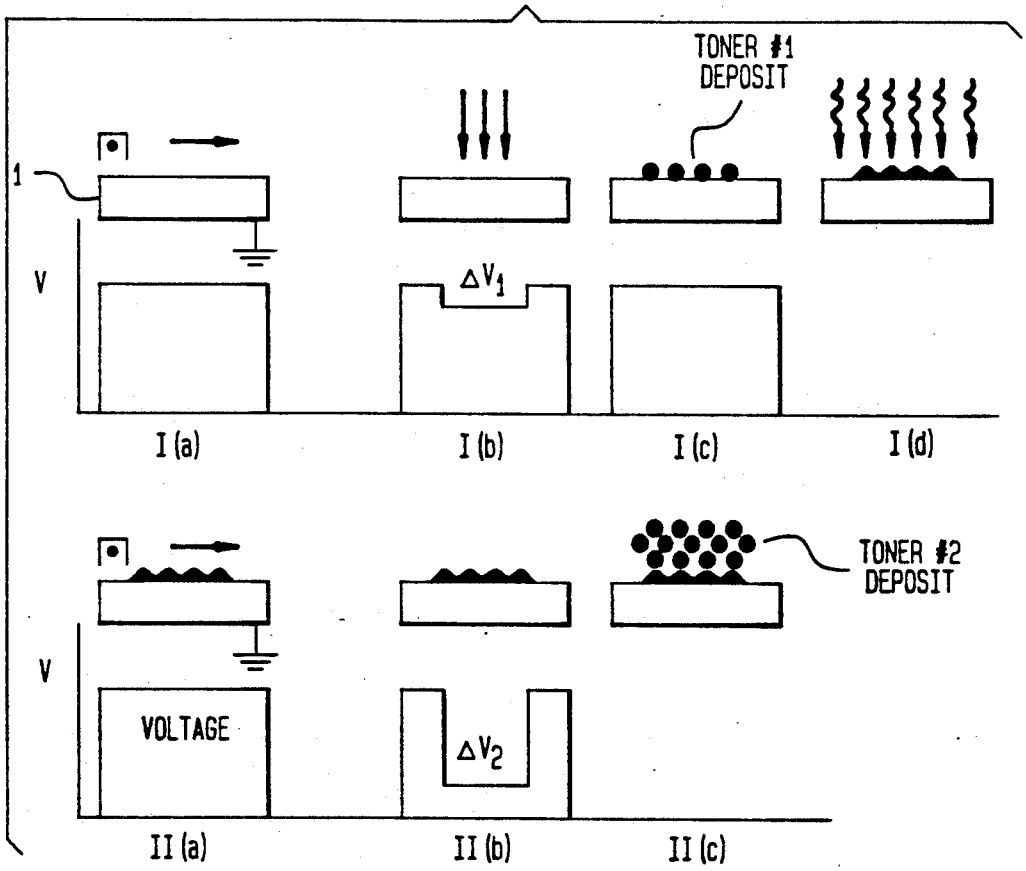
FIG. 1 (PRIOR ART)
FIG. 1 illustrates the steps of traditional charge injection amplification according to the prior art with a graph of surface potential supplied for each step.

FIG. 1 illustrates charge injection amplification as disclosed in U.S. Pat. No. 4,465,749 and using materials essentially the same as those suggested in that patent. A photoconductive imaging member 1 includes at least a photoconductive layer backed by a conductive backing as in traditional electrophotography. At step I(a), element 1 is charged, for example, to a charge of +600 volts. At I(b) the charged element is imagewise exposed to extremely weak radiation, for example, the amount of light available with an ordinary camera exposure. This extremely low exposure (for electrophotography) dissipates a small amount of charge resulting in areas which, for example, have a potential of +580 volts where exposed. At I(c) this differential in charge is toned by application of a charge injection toner to the imaging member 1 to create a toner image defined by the electrostatic image. The toner can be of either polarity thereby toning either the high potential portions of the imaging member or the partially discharged portions of the imaging member. Because the electrostatic image is weak the toner image necessarily is extremely weak, being barely visible.

At I(d) the low coverage charge injection toner image is fused to the imaging member 1. The imaging member is now charged again, for example, to a charge of +600 volts as shown in II(a). As shown in II(b), after a short passage of time the charge has injected itself into the imaging member through the toner, creating a large differential in potential between the toned areas and the untoned areas. This differential is then toned as shown in II(c) by applying toner, again of a positive polarity, and resulting in a greatly amplified image. Again, the electrostatic image created in steps II(a) and II(b) could have been toned with a negative polarity toner creating laydown in the areas that were not originally exposed in step I(b).

The amplified toner image obtained in step II(c) can be retained in place or transferred to a receiving sheet as in ordinary electrophotography. As disclosed in U.S. Pat. No. 4,465,749, after transfer the charge injection toner image can be reused. That is, it can be used as a xeroprinting master.

When these same steps were tried with either a liquid toner as the charge injection toner in step I(c) or a dry small particle toner but without the fusing step charge injection could not be obtained using steps II(a), II(b) and II(c) in any reasonable time. Thus, it was assumed that fusing was necessary in the process and therefore that, not only was the expense of a fusing step required, it would be inconvenient to reuse the imaging member.

EXAMPLE 1

FIG. 2

Figure 2:
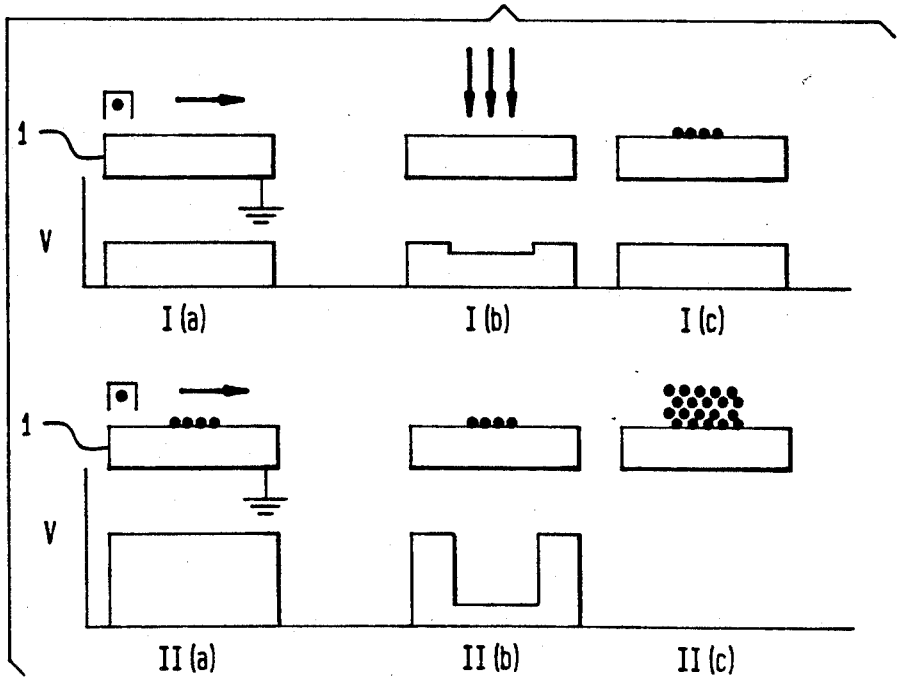
FIG. 2 is similar to FIG. 1 but illustrates the steps of a preferred charge injection amplification process carried out according to the invention, again with a graph of surface potential for each step.

According to FIG. 2, a homogeneous bipolar organic photoconductive imaging member 1 [Kodak Ektavolt (a trademark of Eastman Kodak Company)] recording film, type SO-102 was corona charged to a voltage of +200 volts, as shown in step I(a). The charged imaging member was exposed using a step tablet to low light with sufficient exposure to create a maximum differential in potential of approximately 30 volts as shown in I(b). A positively charged, carbon black pigmented electrographic liquid developer similar to that of the prior art was applied to the imaging member to develop the exposed areas to a 0.14 neutral density. To this point, the process is essentially the same as the prior art shown in FIG. 1. However, the image was not fused.

The imaging member was then charged at step II(a) to a positive +700 volts. After a short waiting time of a few seconds, indicated in Step II(b) of FIG. 2, a voltage was retained in the untoned areas of approximately 700 volts. Charge was injected into the toned areas until a voltage of approximately 300 volts was left in the area of highest toner coverage for a difference in voltage of 400 volts. The same liquid toner was applied to the imaging member and the image of the step tablet toned to produce a maximum density difference of 1.2.

EXAMPLE 2

FIG. 3

A quantitative comparison between the present invention and conventional electrophotography using the same photoconductor and the same toner in both experiments was carried out to demonstrate both the photographic speed increase and the increased gamma (contrast) of the new process. The materials and processing according to the present invention were similar to those of Example 1. A pattern of light was projected through a step tablet onto the surface of a sample of photoconductor charged to a potential of +200 volts, and the resulting electrostatic image was toned with liquid developer using a development electrode to drive toner to the exposed areas of the photoconductor according to steps I(a)-I(c) of FIG. 2. In procedure similar to Example 1, with steps II(a)-II(c) of FIG. 2 and charging to +700 volts, curves a-d were generated on four different film samples, yielding $D_{max}$ values in excess of 1.5 net neutral density.

In a comparison example, curves e-g were generated on three different film samples using increased exposures common in conventional electrophotography, i.e., steps I(a)-I(c) only in FIG. 2. It can be seen that toe speed increased by a factor of approximately 7 when the new process was employed. The speed increase at the shoulder was approximately a factor of 15, resulting from the larger slope of the curves from the present invention.

Figure 3:
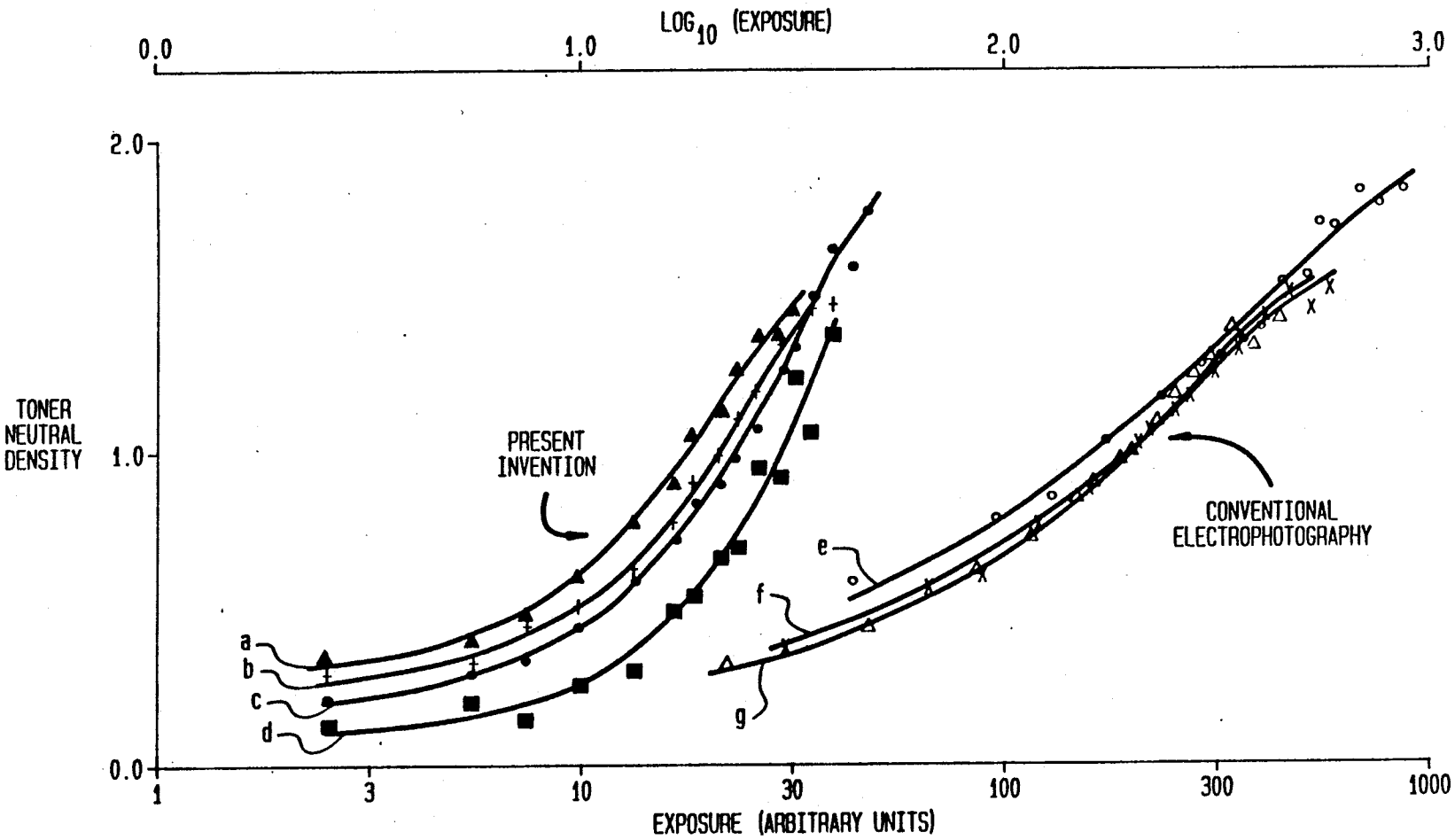
FIG. 3 is a graph plotting toner neutral density against exposure for processes carried out with the invention and with conventional electrophotography, comparatively illustrating both the photographic speed increase and increased gamma aspects of the invention.

In Table 1 are given numerical comparisons of gamma (contrast) as measured from the curves of FIG. 3 and from other measurements using similar materials in the prior art and in conventional electrophotography.

TABLE 1

CONTRAST COMPARISONS

| Process | Toner[a] Sensitivity | $V_1$[b] | $V_2$[c] | Gamma[d] |
|---|---|---|---|---|
| Conventional | 12 | +600 | — | 1.43 |
| | 27 | +600 | — | 1.41 |
| | 12 | +200 | — | 1.25 ± 0.05 |
| Prior Art | 12 | +600 | +600 | 0.92 |
| | 27 | +600 | +600 | 1.17 |
| Present Invention | 12 | +200 | +700 | 2.6 ± 0.6 |

[a]Measured in units of optical density-cm/micro-coulomb.
[b]Potential of first charging (Ib in FIGS. 1 and 2).
[c]Potential of second charging (IIa in FIGS. 1 and 2).
[d]Measured from the linear portions of the density vs. log exposure curves.

The first three lines of Table 1 show results for conventional electrophotography for two different toner sensitivities and two different charging potentials. It is seen that gamma is essentially independent of toner sensitivity but is lower when the charging potential is lower, as in line three of the table measured from curves e–g of FIG. 3. The prior art shows lower contrast (gamma) than conventional electrophotography (compare line 4 with line 1 and line 5 with line 2 of Table 1). On the other hand, the present invention demonstrates a much higher gamma than conventional electrophotography (compare line 6 with line 3 in Table 1). By choosing different values of the first and second charging potentials in the present invention, it is possible to modify the contrast of the new process considerably in a simple manner, avoiding the need for changing the photoconductor or toner.

It appears from this invention that charge injection is inhibited only up to the potential on the image member, i.e., the original charge level. Above that level, charge injection can take place. We believe that the second charging process of FIG. 2, II(a) produces an electric field across the interface between the toner and the imaging member, and that the injection of charge is field-dependent and is driven by this electric field. The electric field lines associated with charges laid down in the first charging of FIG. 2, I(a), and retained after the exposure step, do not cross the interface and therefore do not produce charge injection.

The process works with the same charge injection toners suggested in U.S. Pat. No. 4,465,749. Work done with liquid and dry toners indicates that some charge injection is obtainable with either. However, liquid toners "pancake" much more than dry toners and are more intimately associated with the surface of the imaging member. They are therefore preferred in this process.

The invention thus provides an opportunity to get high-quality continuous tone images from very limited exposures comparable to those used in ordinary photography but without the fusing step of U.S. Pat. No. 4,465,749. The absence of the fusing step not only eliminates an expensive station for a continuous process but also permits the possibility of reusing the imaging element (with dry toners). Thus, this process enables use of a permanent imaging member in apparatus making a variety of images from low exposures. Thus, the imaging member is exposed once, toned, the image amplified and the amplified image toned. At this point the amplified toner image can be transferred. If dry toner is used in the first toning, the image member can be cleaned and reused with a new faint image. Alternatively, the original weak charge injection toner image preferably of the liquid toner type can be reused as a xeroprinting master for more prints before cleaning.

The two toner images can be of different toners. For example, the first toner could be liquid and the second dry, or the toner could have different colors. The only requirement is that the first image be of charge injection toner as described in U.S. Pat. No. 4,465,749. It will be obvious that electron-injecting toners can be used in this invention, in place of hole-injecting (positive charge injecting) toners described in the Examples. These must be used in conjunction with photoconductors that transport injected electrons in the dark, and that are chargeable with negative corona. The alternatives are shown in Table 2. Mode A corresponds to the cited Examples.

TABLE 2

| | Modes of Practising the Invention | | | | |
|---|---|---|---|---|---|
| Mode | First Charging Polarity | Second Charging Polarity | Toner Polarity | Output Image Sense | Injected Charges |
| A | + | + | + | negative | holes |
| B | + | + | − | positive | holes |
| C | − | − | + | positive | electrons |
| D | − | − | − | negative | electrons |

It will be evident from Table 2 that the invention can produce amplified images that are negative (modes A, D) or positive renditions (modes B, C) of the input light pattern when the toner polarity of the first and second toning processes is the same.

In the modes shown in Table 2, the second toner laydown takes place directly above the first toner laydown. It is obvious that by changing the respective polarities of the toners in the first and second tonings, the second toner laydowns would take place in untoned areas left from the first toning.

The invention has been described in detail with particular reference to a preferred embodiment thereof, but it will be understood that variations and modifications can be effected within the spirit and scope of the invention as described hereinabove and as defined in the appended claims.

We claim:

1. A method of amplifying a weak electrostatic image which electrostatic image is obtained by uniformly charging a photoconductive imaging member to a first potential of a first polarity, and imagewise exposing said imaging member to a low level of radiation, said amplification method comprising:

applying a charge injecting toner to said imaging member to create a toner image defined by said electrostatic image, without fusing or otherwise treating said toner image to reduce the charge on said imaging member, charging said imaging member with a charge of the same polarity as the first polarity, but of sufficiently higher voltage than the original charge placed on the imaging member to create an amplified electrostatic image created by charge injection of the charge into said imaging member through said unfused toner image, said amplified electrostatic image having charge of higher potential in areas of less toner and charge of lower potential in areas of more toner.

2. The method according to claim 1 wherein said weak electrostatic image is of positive polarity and said step of applying charge injecting toner to said imaging member includes applying positively charged charge injection toner to said imaging member to create a toner image in the less charged portions of said electrostatic image.

3. The method according to claim 2 further including the step of applying a charged toner to said image element to create a toner image defined by said amplified electrostatic image.

4. The method according to claim 3 wherein said toner applying steps are carried out by applying the same toner to said imaging member.

5. The method according to claim 2 wherein said step of applying charge injection toner includes applying a liquid charge injection toner to said imaging member.

6. The method according to claim 5 further including the step of applying a dry toner to said amplified image to create a toner image defined by said amplified image.

7. The method according to claim 1 further including the step of applying a charged toner to said imaging element to create a toner image defined by said amplified electrostatic image.

8. The method according to claim 7 wherein said toner applying steps are carried out by applying the same toner to said imaging member.

* * * * *